United States Patent [19]

James

[11] 4,197,766

[45] Apr. 15, 1980

[54] COUNTER-BALANCED PUMPING SYSTEM

[76] Inventor: Robert G. James, 3509 Janene Way, Bakersfield, Calif. 93306

[21] Appl. No.: 933,269

[22] Filed: Aug. 14, 1978

Related U.S. Application Data

[63] Continuation-in-part of Ser. No. 824,346, Aug. 15, 1977.

[51] Int. Cl. ..... F16P 1/00

[52] U.S. Cl. ..... 74/611; 166/75 A

[58] Field of Search ..... 166/75; 254/178, 155, 254/184; 74/606 R, 606 A, 611, 89.2, 89.21, 89.22, 216.5; 212/48, 93, 100; 200/61-66; 248/364, 329, 331; 16/193, 194; 417/539; 114/200; 187/94

[56] References Cited

U.S. PATENT DOCUMENTS

| | | | |
|---|---|---|---|
| 1,288,550 | 12/1918 | Forsyth | 74/611 |
| 2,295,582 | 9/1942 | Ingwer | 74/611 |
| 3,793,904 | 2/1974 | Grable | 254/178 |

FOREIGN PATENT DOCUMENTS

| | | | |
|---|---|---|---|
| 137423 | 1/1929 | Switzerland | 74/611 |

*Primary Examiner*—Samuel Scott

*Assistant Examiner*—G. Anderson

*Attorney, Agent, or Firm*—I. Michael Bak-Boychuk

[57] ABSTRACT

The present disclosure sets out an improvement in counterbalanced pumping systems of the type described in my prior application Ser. No. 824,346 filed Aug. 15, 1977 wherein two mandrels are mounted on a common shaft which also is geared through a planetary gearing system to a drive motor. The mandrels play out, in opposing directions two spirally stacked sheave chains, one going to a well bore to support the pumping assembly therein, and the other being extended into a counterbalance pit to support a counterbalancing weight at the end thereof. The stacked mandrels are enclosed in a common housing which also includes the necessary turning rollers for directing the sheave chains into the respective bores, one end of the housing being attachable directly to the exposed end of the well pipe while the other end of the housing being supported on top of the counterbalance pit liner. The housing may thus form a leak-proof enclosure in which sufficient oil may be stored to lubricate the sheave chains and the mandrels. There being no further openings in the housing, other than those communicating with the two bores, unwarranted oil spillage is precluded thus observing the necessary environmental standards now in effect.

4 Claims, 13 Drawing Figures

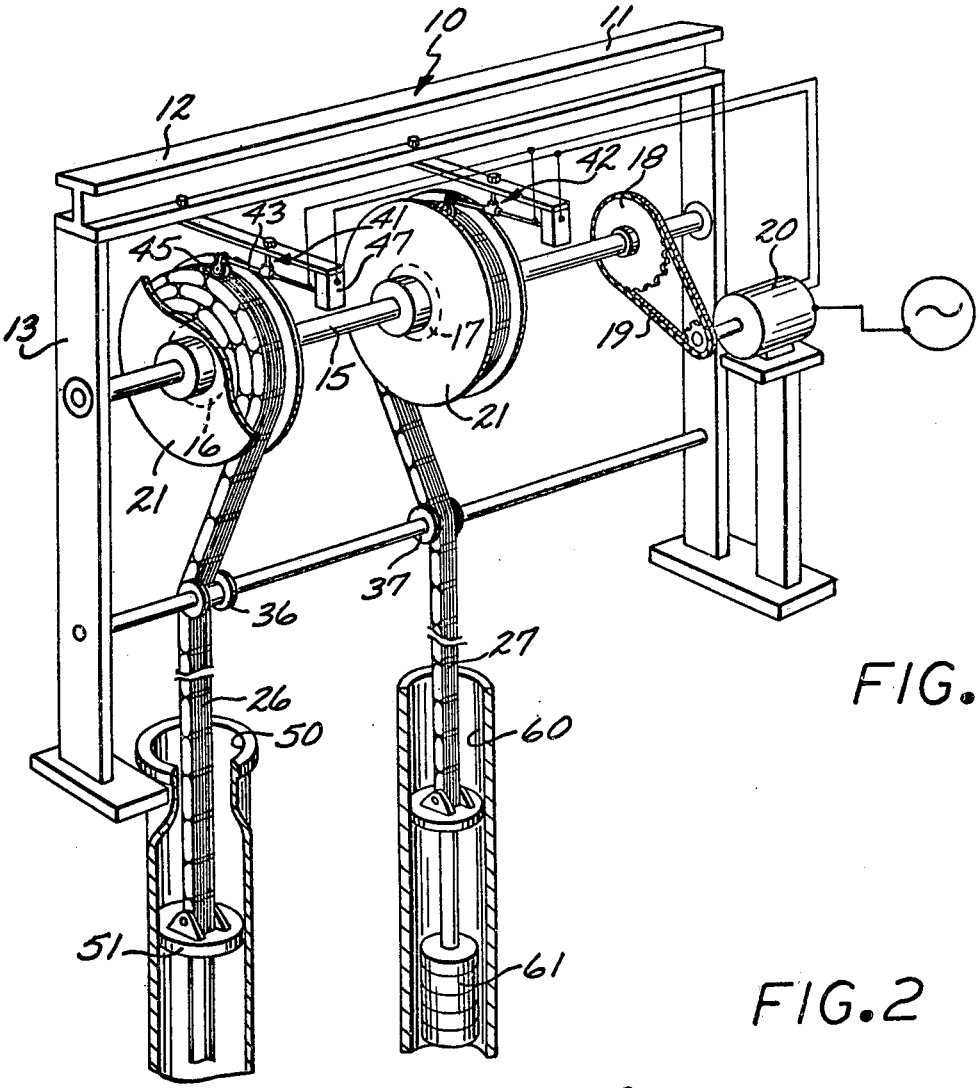
FIG. 1
FIG. 2
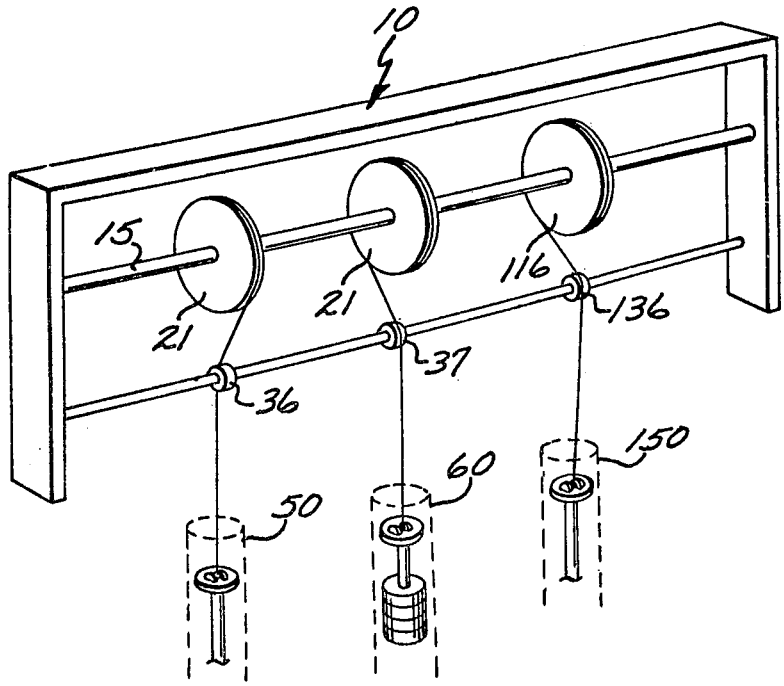

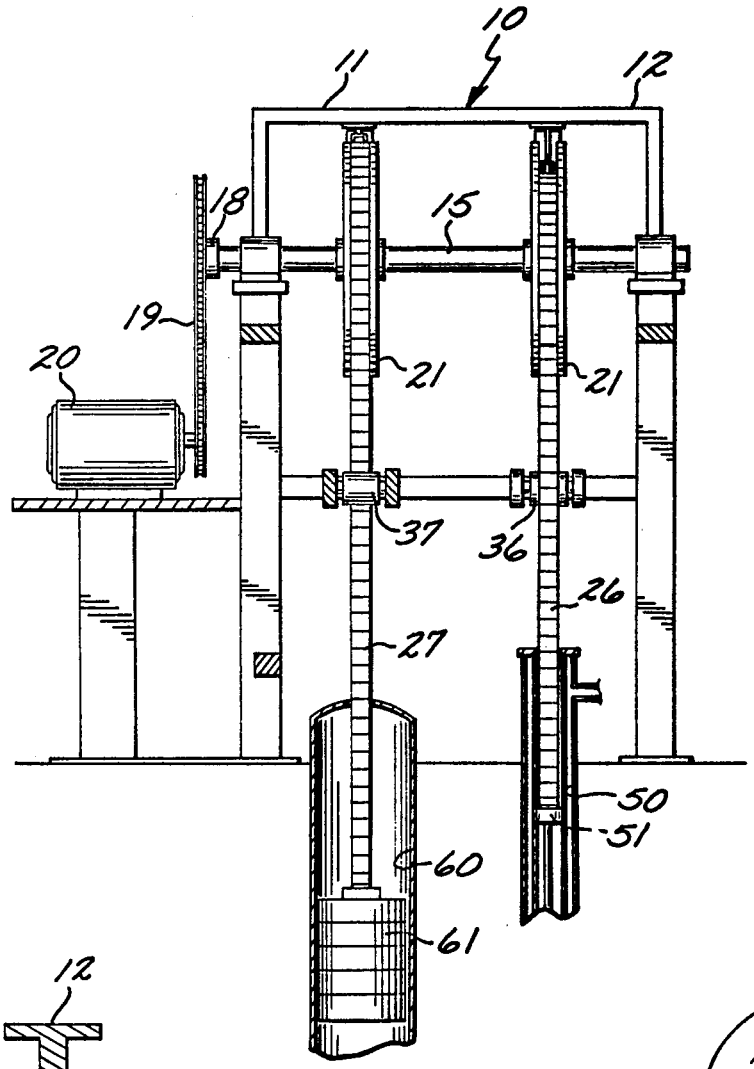
FIG. 3
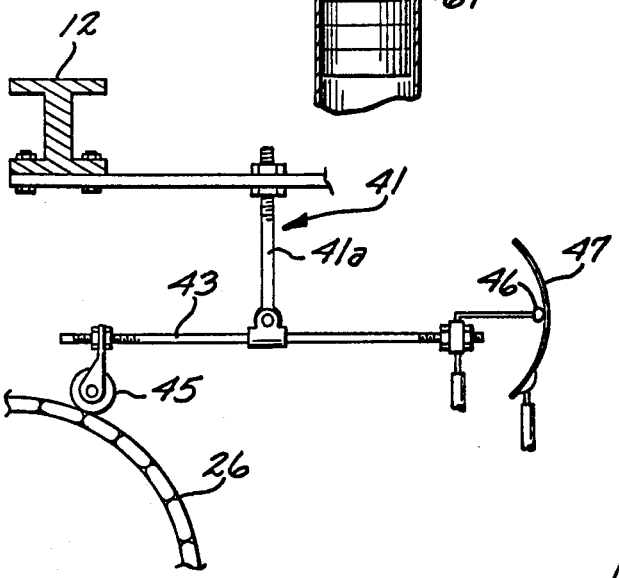
FIG. 5
FIG. 4
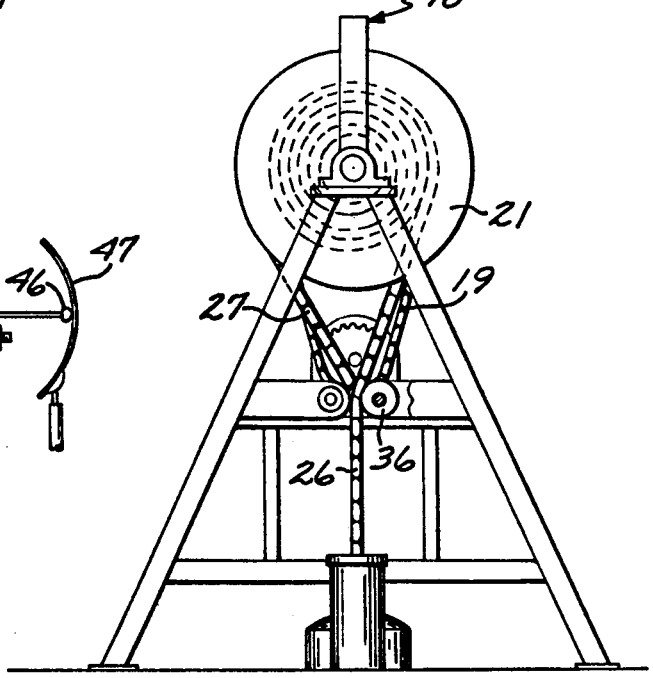

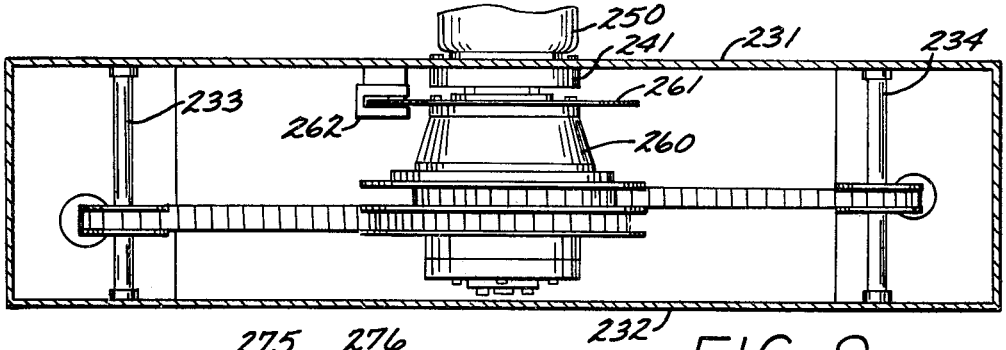
FIG. 9
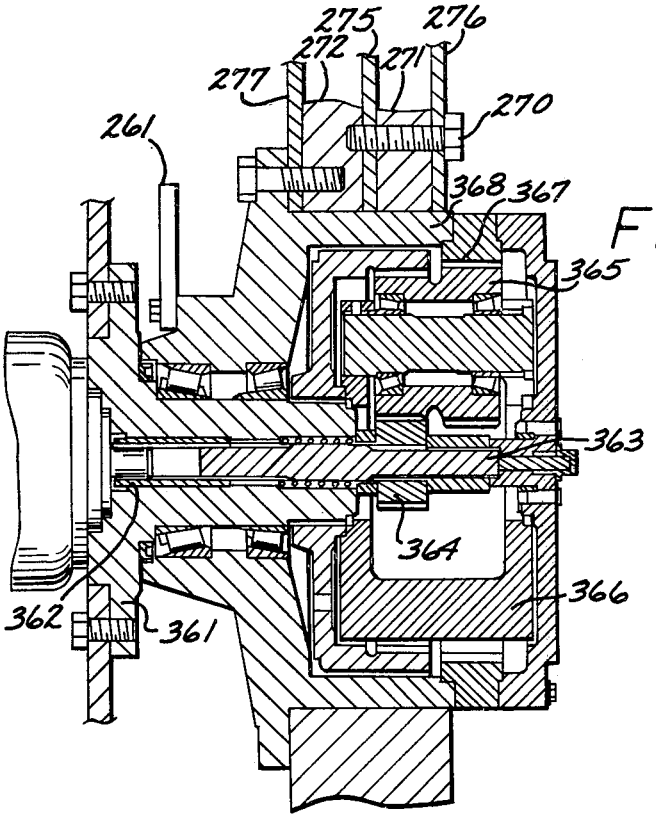
FIG. 10
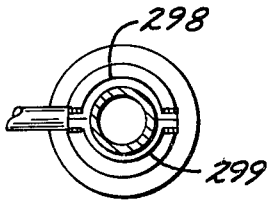
FIG. 11
FIG. 12
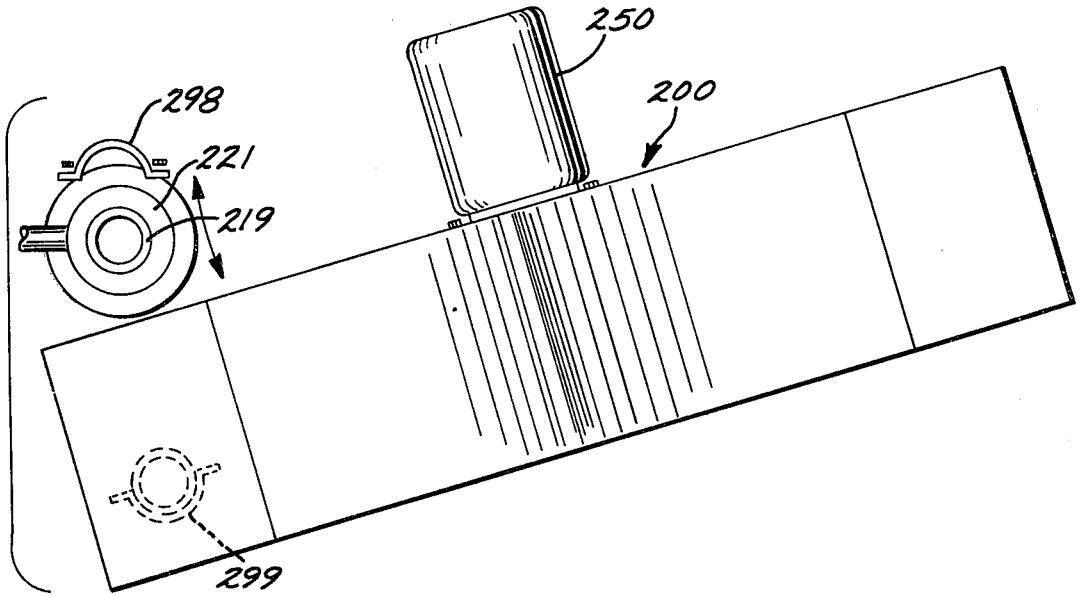

COUNTER-BALANCED PUMPING SYSTEM

CROSS-REFERENCE TO RELATED APPLICATION

The present invention is a continuation-in-part of my co-pending prior application Ser. No. 824,346 filed Aug. 15, 1977 and entitled "counterbalanced pumping system".

BACKGROUND OF THE INVENTION

1. Field of the Invention

Well Head Mounted Counterbalanced Pumping System.

2. Description of the Prior Art

Couterbalanced pumping systems have been known in the past. Typically such pumping systems include flexible cables which are played out over compound cam surfaces and which therefore traverse axially along the surface of the cam. For this reason and because of the necessity for a wide cam ratio substantial structures have been heretofore entailed which because of their mass and size present an unsightly form above ground. With the present interest in maintaining both the visual and the physical aspects of the environment in tact, the large prior art systems have had some opposition thus limiting the access to potential oil producing areas as well as increasing the cost of installation and subsequent maintenance.

SUMMARY OF THE INVENTION

Accordingly it is the general purpose and object of the present invention to provide a counterbalanced pumping system which is directly attachable to a well head.

Other objects of the invention are to provide a counterbalanced pumping system which by virtue of its integral structure can maintain large reservoirs of lubricating fluid.

Yet further objects of the invention are to provide a counterbalanced pumping system which, amongst its features, includes an emergency brank activated upon predetermined exceedances in stroke.

Briefly these and other objects are accomplished in the present invention by arranging a counterbalanced pumping system of the type disclosed in my prior application Ser. No. 824,346 as an integral unit directly attachable to a well head. Generally, my prior counterbalanced pumping system includes a common shaft having secured thereon a plurality of mandrels each mandrel storing in a spiral stackup a corresponding sheave chain. The respective sheave chains are either attached to the pumping assemblies of an oil well or to counterbalancing weights, there being provided guide rollers for turning the chains to an axial alignment relative each bore. The foregoing arrangement provides for a classically oscillating system where the only losses are those associated with friction and the work extended in pumping the fluid. It has been found that the aforementioned mandrels may be stacked in axial alignment on the shaft, the assembly being contained in a common housing also including an oil sump. Thus the sheave chains stored on each mandrel are exposed to the lubricating fluids, further reducing friction and extending life. This common shaft may then be connected to a planetary gear system tied to an electric motor switched in and out by two roller switches extending to engage the exterior rank of each chain.

The housing can then include the necessary openings through which the sheave chains are extended into the respective bores, one sheave chain extending into the well bore while the other extending into a counterbalanced pit. In this manner any fluid losses will be localized either in the counterbalance pit or in the well bore, precluding the undesired spillage heretofore experienced.

BRIEF DESCRIPTION OF THE DRAWINGS

FIG. 1 is a perspective illustration of a first arrangement of the inventive system disclosed herein;

FIG. 2 is a perspective illustration of a second arrangement of the inventive system adapted for plural pumping;

FIG. 3 is a front view of the system shown in FIG. 1;

FIG. 4 is a side view of the system shown in FIG. 1;

FIG. 5 is a detail illustration of a switch assembly useful herein;

FIG. 9 is a top view, in section, taken along line 9—9 of FIG. 8;

FIG. 10 is a detailed view, in section, of a planetary gearing system useful with the invention herein;

FIG. 11 is yet a further detailed view of a mounting fixture useful with the well head mounted assembly disclosed herein;

FIG. 12 is a top view of the well head mounted assembly, illustrating the manipulation thereof during installation.

DESCRIPTION OF THE PREFERRED EMBODIMENT

Figure 6:
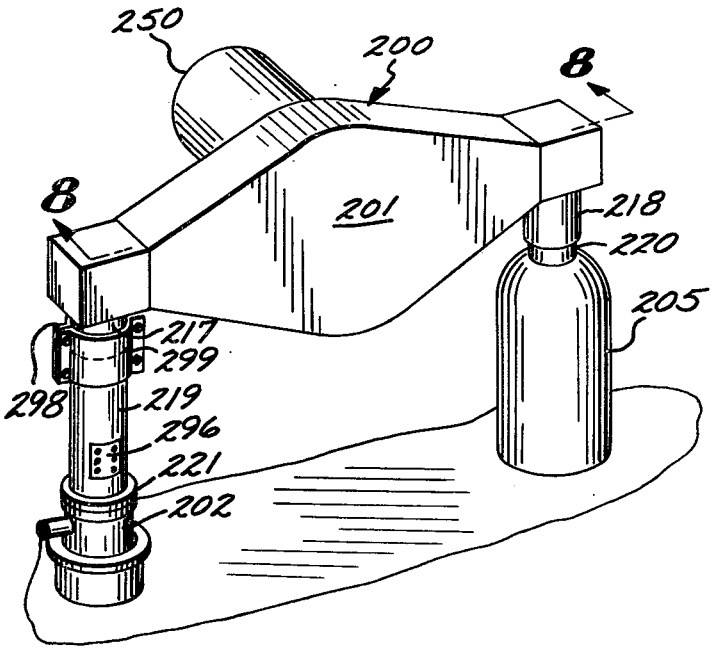
FIG. 6 is yet another embodiment of a counter balanced system conformed as an integral assembly for direct well head mounting.

While the following description is primarily directed to the use of the present device in oil pumping applications, such is exemplary only. It is to be understood that other uses than those set out herein may be achieved by the apparatus disclosed and no intent to limit the scope of the invention thereby is expressed.

As shown in FIGS. 1, 3 and 4 the inventive counterbalanced pumping system, generally designated by the numeral 10, comprises a frame 11 including a horizontal spine member 12 supported at either end by a vertical stand 13 and 14 respectively. Extending below spine member 12 between stands 13 and 14 and supported for rotation therein is a mainshaft 15, shaft 15 being aligned substantially horizontal relative the ground plane. Supported on shaft 15 in spaced relation is a first and second mandrel 16 and 17 respectively, each mandrel being clamped between two circular side walls commonly designated by the numeral 21. It is within this gap between the adjacent side walls clamping mandrels 16 and 16, that a sheave chain is stored; in the illustration herein mandrel 16 storing a sheave chain 26 while mandrel 17 storing a length of sheave chain 27.

The thickness of each mandrel 16 or 17 is substantially equal to the width of the corresponding sheave chain, thus providing a gap between side walls 21 in which the chain is spirally stacked. The direction of wind-up of chains 26 and 27 on the respective mandrels is opposite and when sheave chain 26 is being taken up, sheave chain 27 is being played out. Sheave chains 26 and 27 are each respectively turned about corresponding guide rollers 36 and 37 deployed on shaft 35 aligned below the axis of the mandrels 16 and 17, rollers 36 and 37 providing the necessary angulation of the corresponding chain from the varying angle of departure to a vertical alignment. Thus sheave chain 26, as it departs downwardly from roller 36 is available to extend into a well bore 50, supporting a pumping assembly 51 at the end thereof. Sheave chain 27 on the other hand extends into a balance pit 60 to support a counterbalance 61 on the interior thereof. Each sheave chain, in turn, is fixed at one end to the corresponding mandrel, the mandrels being keyed or otherwise fixed in rotation on shaft 15.

By selective adjustment of the weight of the counterbalance 61 it is possible to achieve matched condition for a balanced equilibrium with the weight of the well pump 51. Thus a classical oscillatory system is achieved. The dynamics of motion of this system are further enhanced by the non-linear increase in the moment of inertia of the respective mandrels or spools which are taking in the chain. The net effect is to exchange the linear mementum for angular momentum at the upper and lower limits of the pumping stroke. Any power input required is therefore only necessary to overcome the friction losses and the fluid head incident to the reciprocal pumping set out. To provide for this power input and in particular in order to compensate for the work expended in bringing the well fluid up to the surface, shaft 15 is further secured to a driven chain sprocket 18 which by way of a chain drive 19 engages an electric motor 29. Motor 20 may be a conventional split phase reversing motor, receiving power from a conventional AC power source S and being switched in reversal by way of the control connections included therein. The switching inputs achieving the necessary motor reversal are provided by two switches 41 and 42 adjustably suspended from the spine member 11 to extend for articulation by the stored sheave chain on the corresponding mandrel 16 and 17.

While the implementation of switches 41 and 42 may be variously achieved for the purposes herein an arrangement shown in FIG. 5 is exemplary. Shown in this figure is switch 41, it being intended to construct switch 42 in the same manner. Thus switch 41 includes a pivoted lever 43, adjustable in length, terminating in a roller 45 riding on the exterior rank of the stored chain 26. The other end of lever 43 supports an insulated contact 46 connected to one of the control inputs to motor 20 extending to contact an arcuate contact strip 47 completing the circuit.

It is intended to suspend switches 41 and 42 on threaded supports 41(*a*) and 42(*a*) thus providing for manual adjustment of the deployment height of each switch. By virtue of this arrangement the contact arc during which the motor is engaged in either forward or reverse direction can be controlled according to the take-up of the respective sheave chain on the corresponding mandrel.

As shown in FIG. 2 the foregoing implementation may be further expanded to include yet another well pump generally designated by the numeral 150, well pump 150 being in turn articulated by a sheave chain 126 extending from yet another mandrel 116 similarly constructed. It is intended to support mandrel 116 on the common shaft 15, the disposition thereof being determined by the separation between the adjacent well bores. In this configuration the counterbalance 61 and its corresponding mandrel 16 functions to accomodate any balance mismatch between the two pumps. This mismatch may be conveniently adjusted by the size of the weight 61 and the diameter of the mandrel 16.

While the classical relationship of the foregoing assembly is non-linear, certain features thereof may be generally set out. Specifically, as each sheave chain is taken up the angular moment of inertia associated therewith increases non-linearly. Thus, towards the limits of each stroke this increase in angular momentum reduces the vertical momentum of the various pumps. It has been found by experimentation that a stroke-to-mandrel build-up of approximately 2 or 3.1 best achieves the desired stroke efficiency. This ratio can best be achieved by selection of the length of stroke and the thickness of sheave chain selected.

Figure 7:
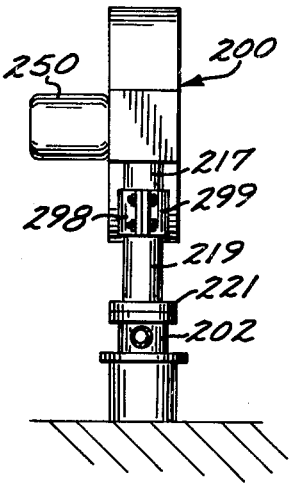
FIG. 7 is a side view of a direct well head mounted embodiment shown in FIG. 6.
Figure 8:
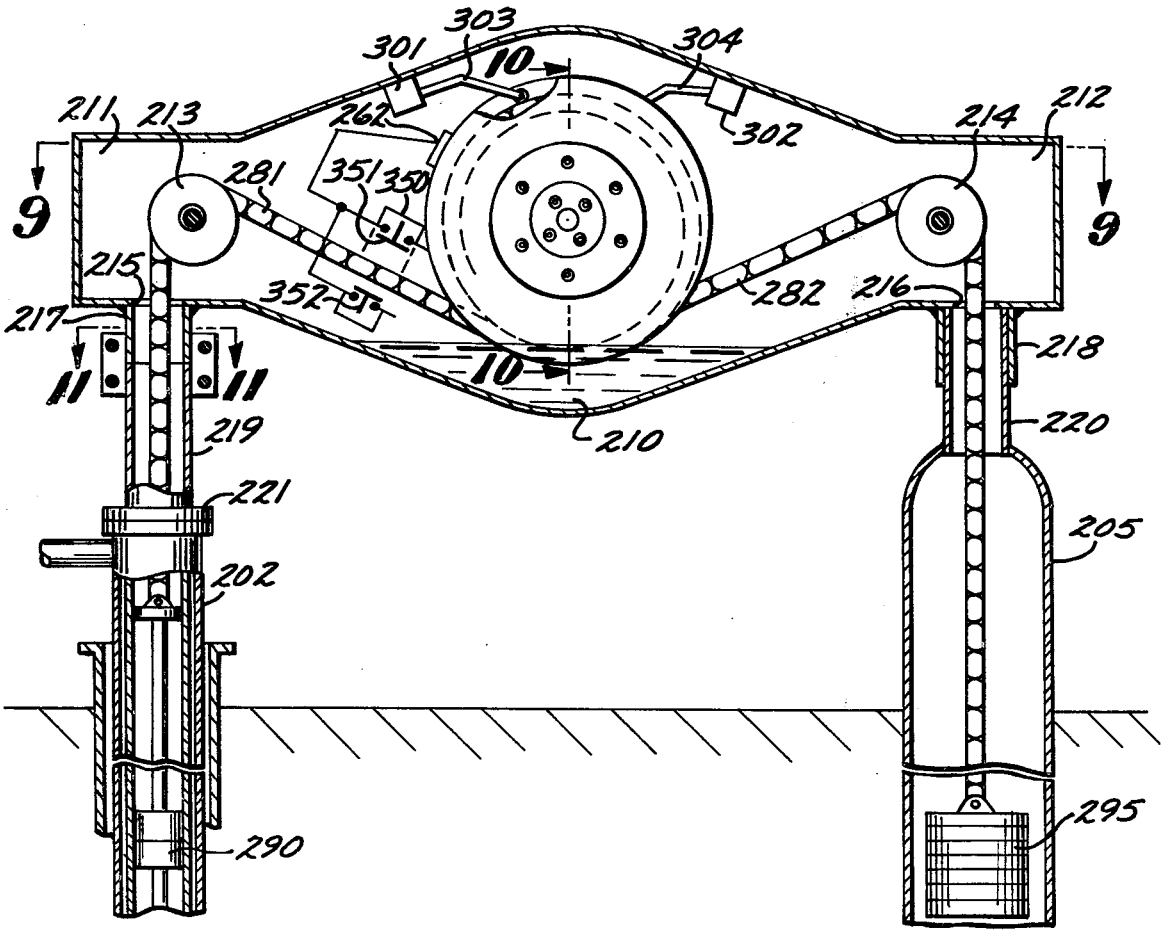
FIG. 8 is a front view of the assembly shown in FIGS. 6 and 7, taken in partial section.

An alternative embodiment, adapted for direct mounting onto a well head, is shown in FIG. 6 comprising a unitized counterbalanced pumping structure generally designated by the numeral 200. The well head mounted system 200 is enclosed in an elongate housing 201 extending between a well head 202 and a counterbalance pit liner 205. More specifically, as shown in FIGS. 6, 7 and 8, housing 201 includes a sump cavity 210 supported between the well head 202 and the counterbalanced cavity 211 and 212 in which respective turning rollers 213 and 214 are deployed. Turning rollers 213 and 214 provide the same function described above for redirecting the respective sheave chain into the corresponding bores. For this purpose cavity 211 includes a bottom opening 215 extending into the interior of a downwardly directed pipe section 217 aligned with a pipe segment 219 supported on a flange 221 on the end of the well head 202 end cavity 212 communicates through an opening 216 to the interior of a downwardly directed collar 218 which is seated on a pipe segment 220 extending upwardly from the liner 205. It is to be understood that the axial alignment of pipe segments 217 and 219 as well as the central axis of well head casing 202 coincide with a vertical tangential axis extending from the outer periphery of turning roller 213. Thus the corresponding sheave chain will drop vertically down into the interior of the well bore as it is guided by the roller. Similarly the alignment of turning roller 214 is such that a tangential, vertically directed axis therefrom aligns with the opening 216, collar 218 and pipe section 220.

As shown in FIGS. 8, 9 and 10, housing 201 comprises two side walls 231 and 232 extending between the end chambers 211 and 212 and providing the side closure for the sump 210. Side walls 231 and 232 include the necessary bearing supports to support two roller shafts 233 and 234, respectively supporting in rotation the aforementioned turning rollers 213 and 214. In addition side plate 231 also includes a centrally disposed flange mounting 241 aligned above the sump 210, flange mounting 241 supporting an electrical motor 250 on the exterior of the housing and a planetary gear assembly 260 on the interior thereof.

Attached to the driven end of the planetary gear assembly 260 is a circular brake disc 261 aligned to pass through an electrically operated caliper 262 over one portion of the periphery thereof. The driving end of the gear assembly 260 in turn attaches to a mandrel assembly 270 comprising first and second axially aligned mandrels 271 and 272, respectively separated by a common separator plate 275 and bounded at either end by end plates 276 and 277. Mandrels 271 and 272 are mounted and secured in rotation to the driving end of the planetary gear assembly 260, mandrel 271 playing out a sheave chain 281 stacked spirally thereon to the turning roller 213 while mandrel 272 plays out the second sheave chain 282 over turning roller 214.

It is to be understood that in a similar manner to that disclosed above, the two sheave chains are wound in opposing directions about their respective mandrels and as one sheave chain is played out the other one is taken in. Sheave chain 281 in turn descends into the well bore where it supports a pumping assembly 290 at the end thereof. Similarly sheave chain 282 descends into the counterbalance liner 205 to support a counterbalance weight 295 at the end thereof.

As shown in FIG. 12 the foregoing assembly may be conveniently installed by first engaging collar 218 onto the pipe segment 220, the other end of the housing being pivoted away from the well head. Once so supported the assembly 200 may be pivoted to align pipe segment 217 with pipe segment 219, pipe segment 219 including an access opening 296 which when opened can be utilized to support the pumping assembly 290. The sheave chain may be thus passed into the interior of pipe 219 and connected through the foregoing access opening to the pumping assembly. Once engaged pipe segment 217 and 219 are then clamped together by way of a clamp 297.

More specifically, as shown in FIG. 11, clamp 297 comprises two clamping shells 298 and 299 tied together by bolts and securing at the common interior thereof the respective pipe segments. These clamping shells overlap the access opening, thus forming the necessary structural connection as well as completing the spill-proof enclosure.

Referring back to FIG. 8 housing 210 includes on the interior thereof two limit switches 301 and 302 respectively aligned over mandrels 271 and 272. Each limit switch is provided with a corresponding lever 303 and 304 extending to engage the exterior rank of the sheave chain stored on the mandrel. Thus as the sheave chains are taken in the respective limit switches are tripped indicating stroke position. Concurrently an override switch 350 in the form of a gate comprising two parallel push-to-close switches 351 and 352 is deployed about the exposed segment of chain 281 indicating overtravel extremes. The signal from switches 351 and 352 is thus an OR signal which is fed to caliper 262 to stop the system on any indication of overtravel. Caliper 262 is straddling the disc 261 tied directly to the driving end of the planetary gear assembly 260. Thus disc 261 rotates along with the mandrels and all failures ahead of the mandrels will show up as overtravel. This provides a safety override which may be placed on a separate circuit according to the description following.

As shown in FIG. 10 the planetary gear assembly 260 includes a flange mount 361 tied to the wall 231 and motor 250. The motor output shaft is then tied by a spline 362 to a sun gear shaft 363 extending through the center of the flange mount. In this manner a sun gear 364 is driven engaging a plurality of planetary gears 365 supported in a planetary carrier 366, gears 365 in turn engaging a ring gear 367 tied to a driving mount 368 which is mounted for rotation in mount 361 and which supports the above-mentioned mandrels 271 and 272 thereon. This rotary driving mount 368 also connects to the disc 261, providing the direct override.

Figure 13:
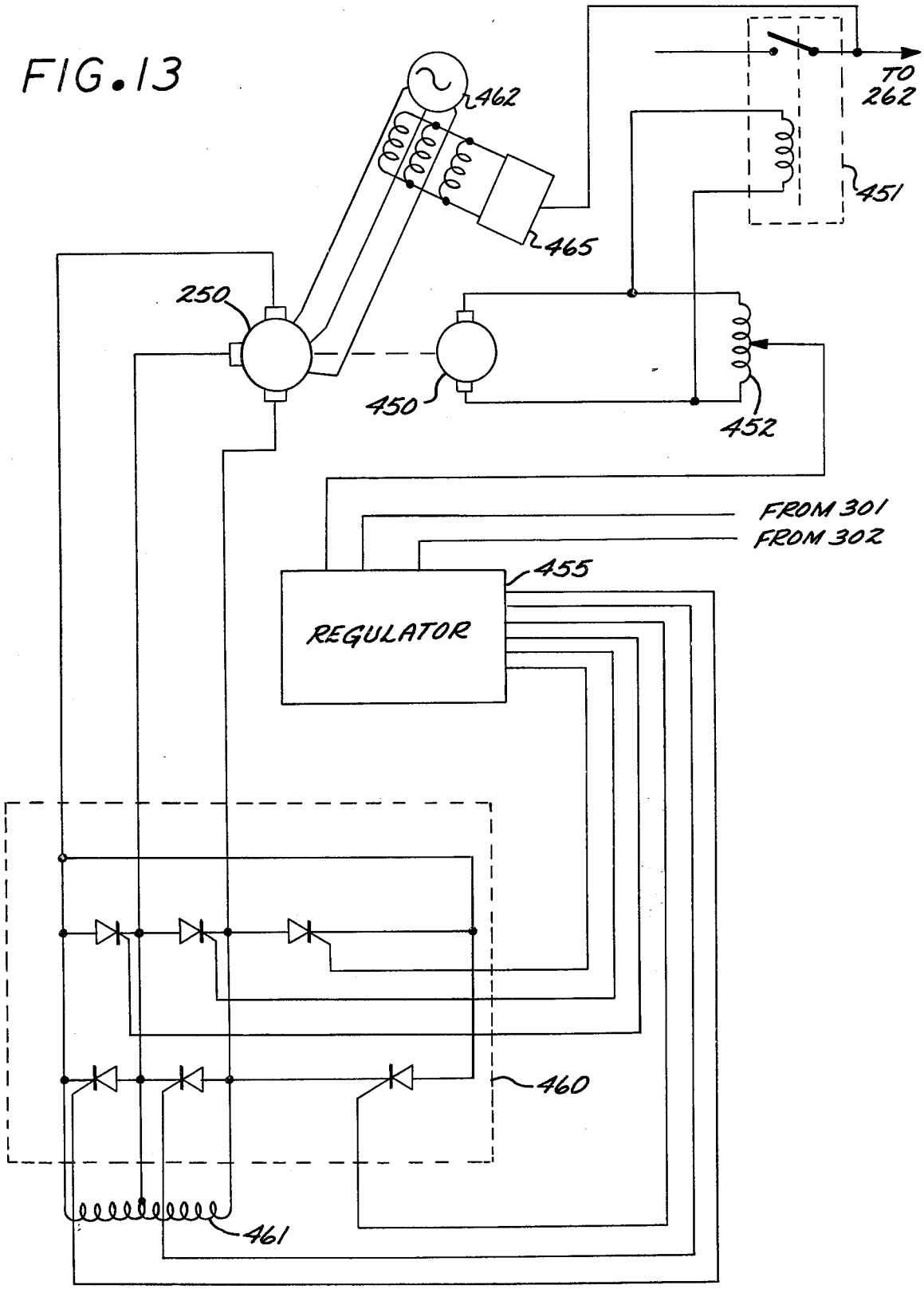
FIG. 13 is a diagram of yet another switching circuit useful with the invention herein.

As shown in FIG. 13 motor 250 is connected to a tachometer 450 exciting both an overspeed relay 451 and the two ends of a cut in potentiometer 452. Relay 451 provides yet another signal to the caliper 262 while the wiper of potentiometer 452 connects to a regulator 455 which controls the gate terminals of an SCR commutation circuit 460 tied to the motor. For the purposes herein, motor 250 is shown as a three phase motor with the necessary phase control transformer 461 and a three phase power input 462. The input power level from input 462 is monitored by a Watt transducer 465 which provides a secondary signal to caliper 262 in instances where pump binding or gear jam occurs. Regulator 455 may include acceleration ramp look ups, operating as a function follower should further power level reductions be desired.

It is to be understood that the sump 210 may be filled with a quantity of lubricating fluid O to a depth where the mandrels are partly immersed therein. Thus the sheave chains will be lubricated by the oil picked up by the mandrel, extending chain life and reducing friction.

Obviously many modifications and changes may be made to the foregoing description without departing from the spirit of the invention. It is therefore intended that the scope of the invention be determined solely on the claims appended hereto.

What is claimed is:

1. In a counterbalanced pumping system for use with a well having a first and second mandrel mounted for common rotation, each connected to a first and second sheave chain respectively and each storing said corresponding sheave chains in opposed spiral stack-up about the peripheries thereof according to the angular rotation of said mandrels, said first sheave chain being connected to balancing weight in a balance pit and said second sheave chain being connected to a well pump deployed in said well, the improvement comprising:

an elongate, hollow housing conformed to extend between said well and said balance pit, said housing including first and second opposed transverse lateral surfaces;

gear means mounted on said first lateral surface and extending on the interior of said housing towards said second lateral surface, said gear means including an input connection extending to the exterior of said housing and an output end driven in geared rotation by said input connection along an axis extending transversely between said pit and said well aligned across said first and second lateral surfaces, said output end being conformed to attach said first and second mandrel around the periphery thereof;

motor means mounted on the exterior of said housing and aligned to engage in rotation said input connection;

a sump cavity formed in said housing subjacent said first and second mandrel for storing lubricating fluids therein in partial immersion of said first and second mandrels;

a first and second opening formed in said housing and aligned above said lubricating fluid said first and second openings being deployed to communicate with said pit and well respectively; and turning means deployed in said housing above said first and second openings for directing said first and second sheave chains from said mandrels to said pit and well.

2. Apparatus according to claim 1 wherein:

said housing is rotatable about said balance pit and said well includes a well head fitting selectively engageable to said housing.

3. Apparatus according to claim 2 wherein:

said gear means includes a brake mounted for common rotation with said first and second mandrels and engageable to said housing upon the exceedance of said stack-up of said sheave chains.

4. Apparatus according to claim 3 wherein:

said motor means includes a tachometer connected for common rotation signal for producing an enabling signal to said brake upon a predetermined exceedance of rotation of said motor means.

* * * * *